United States Patent [19]

Bledsoe

[11] 4,062,128

[45] Dec. 13, 1977

[54] COTTON DRYING APPARATUS

[76] Inventor: Woodrow W. Bledsoe, Upper Lenox Road, Rte. 3, Dyersburg, Tenn. 38024

[21] Appl. No.: 651,923

[22] Filed: Jan. 23, 1976

[51] Int. Cl.[2] ..... F26B 17/10

[52] U.S. Cl. ..... 34/57 R; 34/109; 34/236

[58] Field of Search ..... 34/109, 112, 201, 236, 34/57 R, 57 D, 2

[56] References Cited

U.S. PATENT DOCUMENTS

| | | | |
|---|---|---|---|
| 1,128,592 | 2/1915 | Evans | 34/109 |
| 2,096,208 | 10/1937 | Streun | 34/57 R |
| 2,189,099 | 2/1940 | Bennett | 34/57 R |
| 3,069,730 | 12/1962 | Vandergriff | 34/57 R |

*Primary Examiner*—Kenneth W. Sprague
*Assistant Examiner*—James C. Yeung
*Attorney, Agent, or Firm*—John R. Walker, III

[57] ABSTRACT

Apparatus for removing a certain amount of moisture from moisture laden cotton bolls. The apparatus includes a hopper for receiving the moist cotton bolls and rotatable dispensing structure for controllably metering optimum measures of moist cotton bolls into a fast moving airstream leading into a plenum. The midsection of the plenum housing at least one rotatably driven saw drum which is rotated at a controllable slow rate, e.g., 10-20 RPM. The teeth of the saw drum are arranged with the pointed tip portions respectively trailing the root portions or successively pointed into the airstream as the saw drum is rotated. Accordingly, the cotton bolls are impaled upon the pointed tip portions by the force of the circumfluent air. Therefore, movement of the cotton bolls through the midsection of the plenum is controllably retarded since the velocity of the circumferential surface of the saw drum determines the period of time in which the cotton bolls are exposed to the fast moving airstream, i.e., the saw drum preferably being driven by a variable speed motor. Moisture is drawn from the fibers of the suspended cotton bolls by the uninterrupted airstream which passes through the interstices and opens the locks of the cotton bolls. Accordingly, the slower the saw drum is turned, the dryer the cotton bolls become. The dry cotton bolls are doffed from the saw drum by directing a blast of air onto the saw drum, i.e., this blast of air now being in the same direction in which the teeth are canted.

6 Claims, 5 Drawing Figures

COTTON DRYING APPARATUS

BACKGROUND OF THE INVENTION

1. Field of the Invention

This invention relates to cotton drying apparatus.

2. Description of the Prior Art

Conventional cotton drying apparatus includes a high volume pneumatic conveyor system, e.g., 3500 cu. ft. per min. or approximately 100 cu. meters per minute, which conveyed the cotton through various configured plenums. Generally, the object of the plenum was to agitate the bolls of cotton or redirect them around corners or adjacent to screen structure to enable the air to pass through the locks of the cotton bolls. Additionally, the air used to convey the cotton was heated since heated air picks up or carries away moisture more readily than does ambient air. Naturally, heating this large volume of air is quite expensive. Additionally, the extravagent use of the energy required to heat this large volume of air is prohibitive, particularly in view of the present-day energy crisis.

SUMMARY OF THE INVENTION

The concept of the present invention is to provide apparatus for more efficiently drying seed cotton. An important feature of the present invention is that the seed cotton can now be suitably dried with considerably less expense and with considerably less energy being consumed in the drying process. The apparatus of the present invention may be of a permanent installation or portable. That is, the complete system can be factory assembled and shipped as a unit, or the complete unit can be mounted on wheels, a trailer or truck and be transported to the cotton field for total processing of the cotton in the field. more particularly, the cotton drier herein disclosed is intended to receive the comingled seed cotton and trash direct from the cotton picker, i.e., either at the cotton field or at a centrally located permanent installation. However, it should be pointed out that it is not always necessary to pass the comingled seed cotton and trash through a cotton drier, i.e., only in the event the moisture content is higher than optimum conditions commensurate with the cleaning process.

In any event, the cotton drier of the present invention is intended to pass the seed cotton and trash direct to a cotton cleaner, preferably of the type disclosed in my co-pending application, Ser. No. 592,068 U.S. Pat. No. 3,988,806. In this regard, it is significant to note that the economical and efficient features of the cotton drier herein disclosed are even more enhanced when used in conjunction with the just mentioned cotton cleaner and a cotton gin of the type disclosed in another of my co-pending applications Ser. No. 592,067 U.S. Pat. No. 3,959,851 since the drying air is not simply dumped but rather is used to a distinct advantage in cleaning trash from the seed cotton.

The cotton drying apparatus of the present invention includes a hopper for receiving the moist cotton bolls and a pair of feed rollers establishing dispensing structure for controllably metering an optimum measure of moist cotton bolls into a fast-moving air stream leading into a plenum. The midsection of the plenum houses at least one (single stage), preferably two (two stage), rotatably driven saw drums which are rotated at a controllable slow rate, e.g., 10 to 20 RPM. The teeth of the saw drums are arranged with the pointed tip portions respectively trailing the root portions or successively pointed into the air stream as the saw drum is rotated. Accordingly, the cotton bolls are impaled upon the pointed tip portions by the force of the circumfluent air. Therefore, movement of the cotton bolls through the midsection of the plenum is controllably retarded since the velocity of the circumferential surface of the saw drum determines the period of time in which the cotton bolls are exposed to the fast moving air stream, i.e., the saw drums preferably being driven by a variable speed motor. Moisture is drawn from the fibers of the suspended cotton bolls by the uninterrupted air stream which passes through the interstices and opens the locks of the cotton bolls, i.e., in a mannder comparable to a well known clothes line. Naturally, moisture is more readily removed from garments fixedly attached to a clothes line than would be the case if the garments were free to be carried by the wind. Accordingly, the slower the saw drum is turned the dryer the cotton bolls become. The dry cotton bolls are doffed from the saw drum by directing a blast of air onto the saw drum, i.e., this blast of air now being in the same direction in which the teeth are canted.

More specifically, as the saw drum slowly revolves the circumfluent air stream continues to hold the locks of cotton in place on the saw drum and to open the locks for better drying of fibers and separation of trash from the fibers. Thus, suitably controlling the RPM of the drums regulates the drying time of the cotton exposed to the hot air.

One of the distinct advantages of the cotton drying apparatus herein disclosed is the even and controlled distribution of the cotton over the length of the saw drums, i.e., all cotton is evenly exposed to the drying air. Structure is included whereby the complete system can be regulated by a variable speed motor (or motors) for high or low volume of seed cotton or for high or low moisture content in the seed cotton.

While one drive arrangement or motor may be adequate for certain conditions, it is anticipated that in some installations it may be desirable to have the two feed rollers which establish the dispensing structure to be driven separately, i.e., from the saw drums, etc., in order to interrupt the feeding of cotton into the cotton dryer while continuing to rotate the saw drums, etc.

A very important feature of the present invention is the structure which enables the cotton fibers to be held on the saw drum by the same air that accomplishes the drying, thus permitting the air to absorb the moisture and pass on away from the cotton. This totally new concept is believed to be the most efficient and economical technique to dry cotton since the volume of air for discharging and conveying the cotton to succeeding processing apparatus is small in comparison to other type dyrying systems because the cotton is metered and controlled and evenly distributed in the instant dryer. Therefore, less heat is necessary to heat the air, thus achieving energy conservation and economy.

DESCRIPTION OF THE PREFERRED EMBODIMENT

Figure 1:
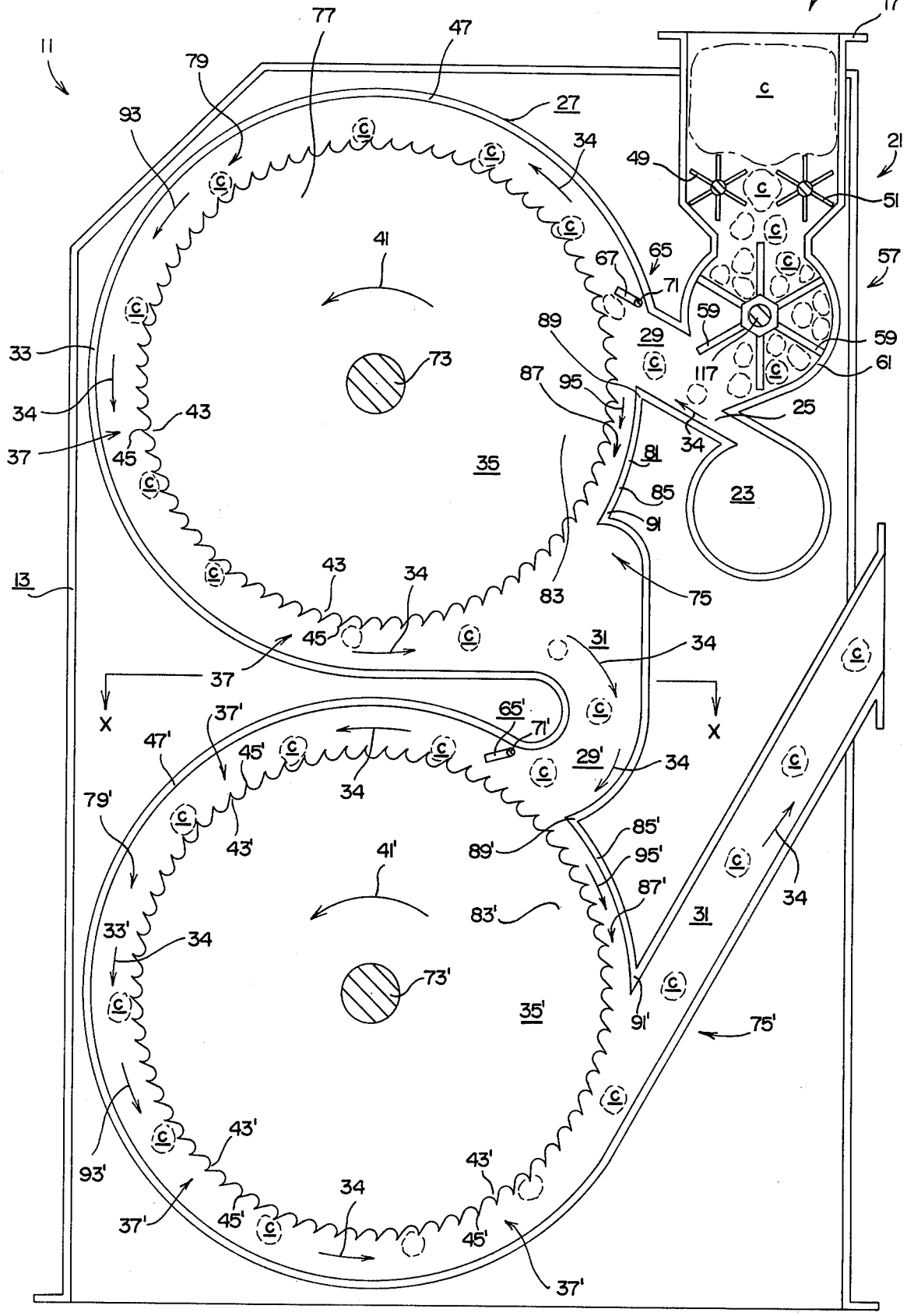
FIG. 1 is a sectional view of the cotton drying apparatus of the present invention with the view being taken as on a vertical plane so as to effectively remove one side panel thereof.

The apparatus 11 of the present invention is intended for removing a certain amount of moisture from moisture laden cotton bolls characterized by the capital letter C. The apparatus 11 includes framelike housing means, as at 13, and at least one prime mover, as at 15, for rotatably driving certain structure of the apparatus 11. However, even though one prime mover 15 may be adapted to accomplish the entire requirements, it will be understood that a second prime mover, as at 15', may be desirable as will be seen later in the specification. The apparatus 11 also includes hopper means 17 including inlet duct means 19 for receiving the moisture laden cotton bolls C, and dispensing means, as at 21, operably coupled to the prime mover 15 for dispensing the cotton bolls C from the hopper means 17. Also included is a source of heated air pressure, e.g., an air blower 23 or the like, including nozzle means 25 disposed adjacent the hopper means 17, as clearly shown in FIG. 1 of the drawings. It will be understood that the means (not shown) for heating the air moved by the blower 23 is accomplished in any convenient manner well known to those skilled in the art.

The apparatus 11 also includes plenum means, as at 27, disposed within the housing means 13 and including an ingress section 29 communicated with the source of air pressure 23, an egress section 31 leading outwardly from the housing means 13, and a midsection 33 interconnecting the ingress and egress sections 29, 31.

Further, from FIG. 1 of the drawings it may clearly be seen that the bolls of cotton C as dispensed from the hopper means 17 are picked up and pneumatically conveyed through the ingress section 29 toward the midsection 33 by an airstream of air pressure (moving in the direction of arrows 34) which is developed by the source of air pressure or air blower 23. Additionally, means, such as a revolving saw drum or cylinder 35, is disposed within the midsection 33 for engaging the bolls of cotton C and for controllably retarding the movement thereof through the midsection 33 while the rushing air is free to pass uninterruptedly through the interstices of the bolls of cotton C thus causing a certan amount of moisture to be removed therefrom. It should be understood that the nozzle means 25 extends across the entire length of the saw drum 35 to evenly distribute the cotton bolls C over the length of the saw drum 35, thus all cotton C is evenly exposed to the drying air.

Figure 3:
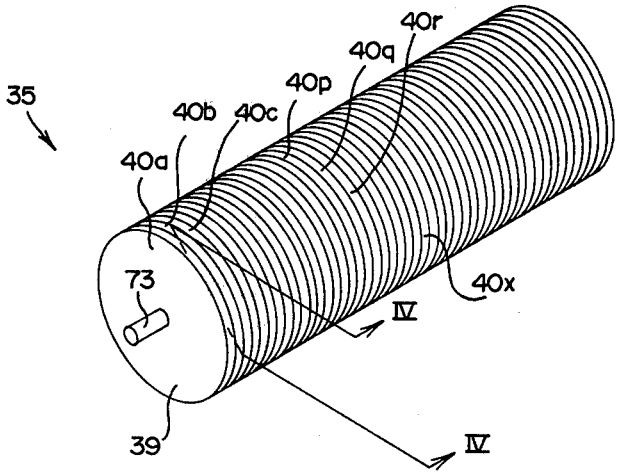
FIG. 3 is an isometric view of one of the saw drums, with the saw drum being removed from the drying apparatus to more clearly illustrate the structure thereof.
Figure 4:
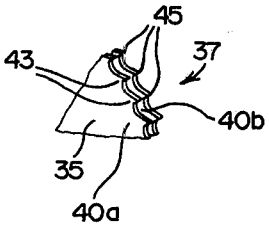
FIG. 4 is a partial isometric view with the view being taken as on the line IV—IV of FIG. 3, showing the details of the teeth structure of the saw drum.

The revolving saw drum or cylinder 35 alluded to above is clearly shown in FIGS. 3 and 4 of the drawings and includes channel saw teeth 37 that are normally made on a flat piece of metal and formed into the channel where they are notched to make the teeth 37 and these are then wrapped around the cylinder body 39 and suitably attached to the body 39 with the saw teeth 37 substantially covering the entire circumferential portion of the drum or cylinder body 39 as indicated in FIG. 3 and in a manner well known to those skilled in the art thus, establishing a multiplicity of circular rows 40 of teeth 37 which are individually designated **40*a*, 40*b*, and 40*c*,** etc.

Figure 2:
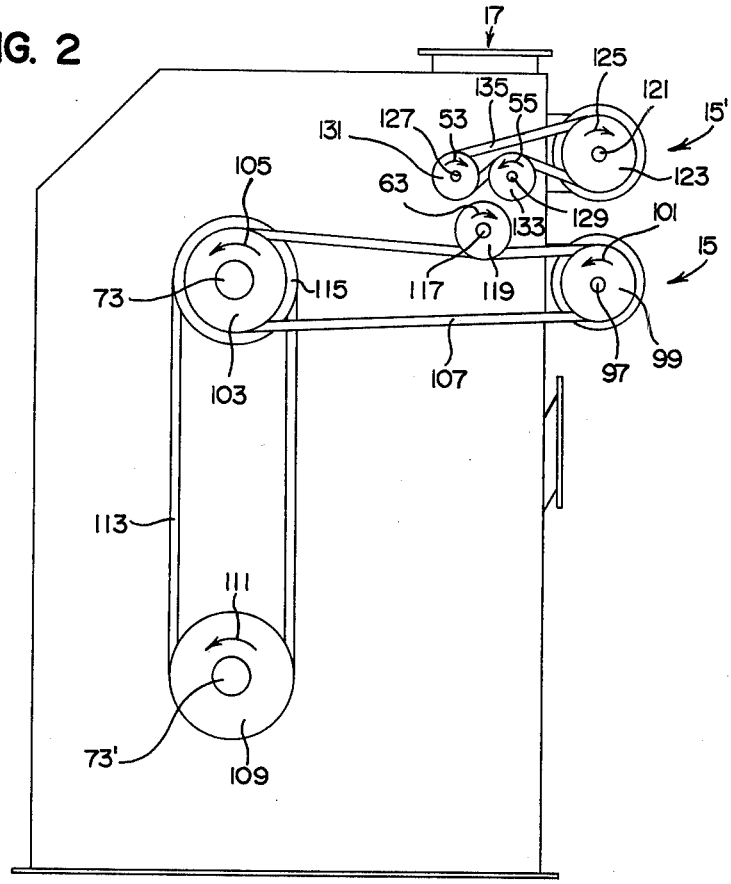
FIG. 2 is a view similar to FIG. 1 with the view being taken prior to the side panel being removed and shows the preferred arrangement of certain drive structure.

From FIGS. 1 and 2 of the drawings it may clearly be seen that the revolving saw drum means or cylinder 35 is operably coupled to the prime mover 15 for rotation about the longitudinal axis thereof in the direction of an arrow 41 and the numerous radially extending teeth or channel saw teeth 37 are uniformly distributed substantially over the entire circumferential surface thereof. Further, the channel saw teeth 37 respectively include root and pointed tip portions thereof, as at 43, 45, establishing angularly canted profiles as clearly shown in FIG. 1 with the pointed tip portions 45 respectively trailing the root portions 43 as the saw drum 35 is caused to rotate. The cotton bolls C are caused to be impaled upon the pointed tip portions 45 by the force of air passing through the midsection 33 with the air being circumfluent to the saw drum means 35, i.e., the plenum means 27 including a scroll sheet 47 disposed a predetermined distance circumjacent to the saw drum 35 to direct the air to move in the direction of the arrows 34. Therefore, the retarded movement of the cotton bolls C through the midsection 33 is totally dependent upon the velocity of the circumferential surface of the saw drum means 35. The prime mover 15 preferably includes structure for varying the speed thereof, in a manner well known to those skilled in the art. Accordingly, the saw drum 35 would preferably be slowed down when the moisture content of the cotton bolls C is relatively high and conversely could be speeded up when the moisture content of the cotton bolls C is relatively low.

The dispensing means 21 alluded to above preferably includes a pair of feed rollers 49, 51 disposed near the bottom of the hopper means 17 and rotated in the direction of the respective arrows 53, 55 as shown in FIG. 2 of the drawings. Since the speed of the saw drum 35 may be varied, as suggested above, it is desirable that the feed rollers 49, 51 be independently controlled. Accordingly, the second prime mover 15' rotatably drives the feed rollers 49, 51. Further, the prime mover 15' also preferably includes structure for varying the speed of the feed rollers 49, 51 in a manner known ot those skilled in the art.

The dispensing means 21 also preferably includes a rotary vacuum feeder 57 which includes a plurality of rubber type seals 59. In other words, the rotary vacuum feeder 57 comprises a typical bucket wheel having the rubber flashing or rubber type seals 59 on the end of each bucket so that it seals against a scroll member 61 in a manner well known to those skilled in the art. The rotary vacuum feeder 57 preferably is rotated in the direction of an arrow 63 as clearly shown in FIG. 2 of the drawings.

Figure 5:
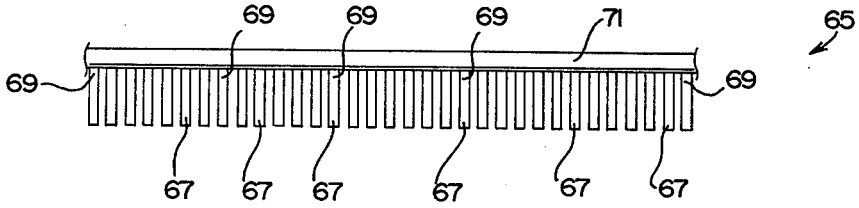
FIG. 5 is an elevational view of one of the Lambrequin members of the present invention with the Lambrequin being removed from the apparatus to more clearly illustrate the structure thereof.

The apparatus 11 preferably includes Lambrequin means 65 disposed within the plenum means 27 for guidingly directing the cotton bolls C toward the saw drum means 35 while permitting an uninterrupted flow of air to pass into the midsection 33. The Lambrequin means 65 is shown in FIG. 5 of the drawings as a separate component so as to sufficiently disclose the structure thereof. The Lambrequin means 65 includes a plurality of parallel spaced apart tines 67 which are arranged in a straight line and have the respective root portions 69 thereof fixedly attached to a shaft member 71. From FIG. 1 of the drawings it may be seen that the shaft member 71 extends substantially parallel with the rotating axis or shaft 73 of the saw drum 35. Accordingly, the tines 67, being closely spaced apart, preclude passage therebetween of the cotton bolls C thus guidingly direct the cotton bolls C toward the saw drum 35. On the other hand, the air moving through the plenum means 27 is not interrupted by the tines 67.

The apparatus 11 also includes doffing means generally characterized by the numeral 75 for removing the cotton bolls C from the saw drum means 35. The doffing means 75 will be more fully disclosed as the specification proceeds.

The plenum means 27 includes first arcuate platelike means or the previously mentioned scroll sheet 47 circumposed about a first segment, as at 77, of the saw drum means 35 for establishing a primary circumfluent air passageway 79 extending about the first segment 77.

From FIG. 1 of the drawings it may also be seen that a portion, as at 81, of the plenum means 27 and a portion, as at 83, of the saw drum means 35 jointly establish at least in part the doffing means 75 alluded to above. More specifically, the plenum means 27 ncludes a second arcuate platelike member 85 circumposed about the portion 83 of the saw drum for establishing a secondary circumfluent air passageway, as at 87, which extends about the second segment 83 of the saw drum 35. Further, remote portions, as at 89, 91, of the platelike means 85 respectively terminate adjacent the ingress and egress sections 29, 31 with the circumfluent air moving through the secondary air passageway 87 being in an opposite direction about the saw drum 35 with respect to the air moving through the primary air passageway 79, i.e., the air moving through the primary passageway 79 being in the direction of an arrow 93 while an arrow 95 shows the direction of the air moving through the secondary air passageway 87. Thus, the cottong bolls C are doffed from the saw drum means 35 by the air moving through the secondary passageway 87 and they become airborne as they are moved into the main airstream (shown by the arrow 34) emanating from the primary air passageway 79.

From the foregoing disclosure it will be appreciated that I am enabled to secure several advantages in connection with drying cotton bolls. However, having considered the manner in which the above concepts are implemented, it is now appropriate to note that the above disclosure pertained to a single stage cotton dryer apparatus. In other words, the above disclosure was directed to the structure depicted in FIG. 1 which lies above the line X—X. Accordingly, the cotton dryer herein disclosed preferably includes the structure depicted below the line X—X in FIG. 1 or is a two stage dryer. Since the structure depicted below the line X—X is similar in every respect with certain structure previously described, it should be sufficient to simply note that the structure of the second stage which is similar to the structure in the first stage will be identified with the same numeral but will have prime suffixes to readily distinguish one from the other. The primary advantage of incorporating the second stage is that the cotton bolls C are more effectively dried by simply removing them from the first stage and introducing them through the second stage with the objective being to fluff the cotton bolls C somewhat and turn or invert them so as to more effectively expose the most moisture laden fibers to the circumfluent air.

Particular attention is now directed towards FIG. 2 of the drawings wherein it may be seen that the primary mover 15 includes a driven shaft 97 which drives pulley structure or sprocket structure 99 in the direction of an arrow 101. Pulley structure or sprocket structure 103 is fixedly attached to the shaft 73 and is rotatably driven in the direction of an arrow 105 by an endless belt or chain which couples the pulleys 99, 103 one to the other. A pulley or sprocket structure 109 is rotatably driven in the direction of an arrow 111 by an endless belt or chain 113. More specifically, a second pulley or sprocket 115 is also attached to the shaft 73 with the belt 113 coupling the pulleys 109, 115 in a manner well known to those skilled in the art. The rotary vacuum feeder 57 includes a shaft 117 and pulley or sprocket structure 119 which suitably engages the belt or chain 107 so as to drive the shaft and pulley 117, 119 in the direction of the arrow 63.

The second prime mover 15' includes a rotatably driven shaft 121 and a pulley or sprocket structure 123 which are rotatably driven in the direction of an arrow 125. The feed rollers 49, 51 respectively include shafts 127, 129 and pulley or sprocket members 131, 133. An endless belt or chain structure 135 suitably couples the pulleys or sprockets 123, 131, 133 one with the other to effectively rotate the shafts 127, 129 in the direction of the respective arrows 53, 55.

Although the invention has been described and illustrated with respect to a preferred embodiment thereof, it is to be understood that it is not to be so limited since changes and modifications may be made therein which are within the full intended scope of the invention.

I claim:

1. Apparatus for removing a certain amount of moisture from moisture laden cotton bolls, said apparatus comprising framelike housing means, a prime mover for rotatably driving certain structure of said apparatus, hopper means including inlet duct means for receiving the moisture laden cotton bolls and means operably coupled to said prime mover for dispensing the cotton bolls from said hopper means, a source of air pressure including nozzle means disposed adjacent said hopper means; plenum means disposed within said housing means and including an ingress section communicated with said source of air pressure, an egress section leading outwardly from said housing means, and a midsection interconnecting said ingress and egress sections; the bolls of cotton dispensed from said hopper means being picked up and pneumatically conveyed through said ingress section and toward said midsection by an airstream being developed by said source of air pressure, and means disposed within said midsection for engaging the bolls of cotton, for suspending the bolls of cotton in the airstream and for controllably retarding the movement thereof through said midsection while the rushing air is free to pass uninterruptedly through the interstices of the bolls of cotton thus causing a certain amount of moisture to be removed therefrom, and wherein said means for engaging the bolls of cotton includes a plurality of pointed teeth for impaling the bolls of cotton to suspend the bolls of cotton in the airstream.

2. Apparatus for removing a certain amount of moisture from moisture laden cotton bolls, said apparatus comprising framelike housing means, a prime mover for rotatably driving certain structure of said apparatus, hopper means including inlet duct means for receiving the moisture laden cotton bolls and means operably coupled to said prime mover for dispensing an optimum amount of the cottom bolls from said hopper means, a source of air pressure including nozzle means disposed adjacent said hopper means; plenum means disposed within said housing means and including an ingress section communicated with said source of air pressure, an egress section leading outwardly from said housing means, and a midsection interconnecting said ingress and egress sections; the bolls of cotton dispensed from said hopper means being picked up and pneumatically conveyed through said ingress section and toward said midsection by an airstream generated by said source of air pressure, and at least one cylinder shaped saw drum means disposed within said midsection for controllably retarding the movement of the cotton bolls therethrough and for suspending the bolls of cotton in the airstream, said saw drum means being operably coupled to said prime mover for rotation about the longitudinal axis thereof and having numerous radially extending teeth uniformly distributed substantially over the entire circumferential surface thereof, said teeth respectively having root and pointed tip portions thereof establishing angularly canted profiles with said pointed tip portions respectively trailing said root portions as said saw drum is caused to rotate, the cotton bolls being caused to be impaled upon said pointed tip portions by the force of air passing through said midsection with the air being circumfluent to said saw drum means, the retarded movement of the cotton bolls through said midsection being dependent upon the velocity of the circumferential surface of said saw drum means.

3. The apparatus as set forth in claim 2 in which is included doffing means for removing the cotton bolls from said saw drum means.

4. The apparatus as set forth in claim 2 in which is included Lambrequin means disposed within said plenum means for guidingly directing the cotton bolls toward said saw drum means while permitting an uninterrupted flow of air to pass into said midsection.

5. The apparatus as set forth in claim 2 in which said plenum means includes first arcuate platelike means circumposed about a first segment of said saw drum means for establishing a primary circumfluent air passageway extending about said first segment of said saw drum means.

6. Apparatus for removing a certain amount of moisture from moisture laden cotton bolls, said apparatus comprising framelike housing means, a prime mover for rotatably driving certain structure of said apparatus, hopper means including inlet duct means for receiving the moisture laden cotton bolls and means operably coupled to said prime mover for dispensing an optimum amount of the cotton bolls from said hopper means, a source of air pressure including nozzle means disposed adjacent said hopper means; plenum means disposed within said housing means and including an ingress section communicated with said source of air pressure, an egress section leading outwardly from said housing means, and a midsection interconnecting said ingress and egress sections; the bolls of cotton dispensed from said hopper means being picked up and pneumatically conveyed through said ingress section and toward said midsection by an airstream generated by said source of air pressure, and at least one cylinder shaped saw drum means disposed within said midsection for controllably retarding the movement of the cotton bolls therethrough, said saw drum means being operably coupled to said prime mover for rotation about the longitudinal axis thereof and having numerous radially extending teeth uniformly distributed substantially over the entire circumferential surface thereof, said teeth respectively having root and pointed tip portions thereof establishing angularly canted profiles with said pointed tip portions respectively trailing said root portions as said saw drum is caused to rotate, the cotton bolls being caused to be impaled upon said pointed tip portions by the force of air passing through said midsection with the air being circumfluent to said saw drum means, the retarded movement of the cotton bolls through said midsection being dependent upon the velocity of the circumferential surface of said saw drum means, portions of said plenum means and said saw drum means jointly establishing at least in part doffing means for removing the cotton bolls from said drum means, said plenum means having first arcuate platelike means circumposed about a first segment of said saw drum means for establishing a primary circumfluent air passageway extending about said first segment of said saw drum means and having second arcuate platelike means circumposed about a second segment of said saw drum means for establishing a secondary circumfluent air passageway extending about said second segment of said saw drum means, remote portions of said second arcuate platelike means respectively terminating adjacent said ingress and egress sections with the circumfluent air moving through the secondary air passageway being in an opposite direction about said saw drum means than the air moving through the primary air passageway, thus cotton bolls are doffed from said saw drum means by the air moving through the secondary air passageway and become airborne as they are moved into the main airstream emanating from said primary air passageway.

* * * * *